US007232370B1

(12) United States Patent
Newell

(10) Patent No.: US 7,232,370 B1
(45) Date of Patent: Jun. 19, 2007

(54) ADJUSTABLE ROOF JACK WITH FLEXIBLE BOOT

(75) Inventor: Kent Newell, Denver, CO (US)

(73) Assignee: Hercules Industries, Inc, Denver, CO (US)

( * ) Notice: Subject to any disclaimer, the term of this patent is extended or adjusted under 35 U.S.C. 154(b) by 18 days.

(21) Appl. No.: 11/157,692

(22) Filed: Jun. 20, 2005

(51) Int. Cl.
*F24F 7/00* (2006.01)

(52) U.S. Cl. ..... 454/366; 454/364; 454/66; 454/275; 52/199; 52/200

(58) Field of Classification Search ..... 454/364, 454/41
See application file for complete search history.

(56) References Cited

U.S. PATENT DOCUMENTS 3,934,383 A * 1/1976 Perry et al. ..... 52/200
5,409,266 A * 4/1995 Baker ..... 285/44
6,623,540 B2 * 9/2003 Hodge et al. ..... 55/480

* cited by examiner

*Primary Examiner*—Kenneth Rinehart
*Assistant Examiner*—Samantha A. Miller
(74) *Attorney, Agent, or Firm*—Edwin H. Crabtree; Ramon L. Pizarro

(57) ABSTRACT

An adjustable roof jack adapted for mounting on a flat or pitched roof. The roof jack is connected to a lower end of an air discharge duct from an air conditioning unit and to the top of an air supply duct in the roof. The roof jack includes an angular-shaped sheet metal lower frame member having a front side, back side, a first side and second side. A lower portion of the sides of the lower frame member is received around the top of the air supply duct. Also, the lower portion of the sides of the lower frame member is integrally formed into to an outwardly extending roof flange. The roof jack also includes an angular-shaped sheet metal upper frame member having a front side, a back side, a first side and second side. A top portion of the front side of the upper frame member is hinged to a bottom portion of the front side of the upper frame member. A flexible boot is attached to an inside of the top portion of the sides of the lower frame member and to an inside of a lower portion of the sides of the upper frame member. The flexible boot is adapted for receipt around a portion of the air discharge duct.

12 Claims, 3 Drawing Sheets

ADJUSTABLE ROOF JACK WITH FLEXIBLE BOOT

BACKGROUND OF THE INVENTION (a) Field of the Invention

This invention relates to a roof jack for connecting an air discharge duct from a roof mounted air conditioning unit to an air supply duct in a roof of a building and more particularly, but not by way of limitation, to an adjustable roof jack with a flexible boot for receiving a portion of the air discharge duct therein. The roof jack is adaptable for both flat and different pitch roofs.

(b) Discussion of Prior Art

Heretofore, there have been various designs and shapes of roof jacks used with roof mounted evaporative coolers, air conditioning units, heat pumps and the like mounted on flat and pitched building roofs.

In U.S. Pat. No. 5,409,266 to Baker, an adjustable roof jack is disclosed. The roof jack includes an upper rectangular box-like member pivotally attached to a lower rectangular box-like member. The pivot points are located intermediate the front and back of the two members.

In U.S. Pat. No. 4,895,066 to Carnahan, another type of roof jack is described having an upper frame member pivoted on top of a lower frame member. The upper frame member includes extension panels, which are attached to a side of the lower frame member.

In U.S. Pat. Nos. 4,781,401 and 4,526,091 to Sharp, two different types of adjustable roof jacks are disclosed. One roof jack includes an adjustable duct section with a curved end used for connecting to an air duct bend. The other roof jack includes a single sheet metal pattern with duct sections connected to each other with a sheet metal bend hinge. The hinge allows for angle adjustments on different pitch roofs.

In U.S. Pat. No. 4,893,608 to Reaser, a furnace roof jack is described having a pivoting flashing plate. The flashing plate is attached to pitched roofs having various pitch angles.

None of the above prior art patents disclose the unique features, functions and advantages of the subject adjustable roof jack with flexible boot as described herein.

SUMMARY OF THE INVENTION

In view of the foregoing, it is a primary objective of the subject invention to provide an adjustable roof jack, which is easily adapted for mounting on both flat roofs and various pitched roofs.

Another object of the invention is the roof jack includes a flexible boot adapted for receipt around a lower end of an air discharge duct. The boot provides a positive seal around the air discharge duct and helps dampen vibration from airflow circulating through the roof jack.

Still another object of the invention is the roof jack is rugged construction, lightweight, and easily adapted for attaching to various types and designs of air conditioning units, evaporative coolers, and similar roof mounted cooling equipment.

The adjustable roof jack is adapted for mounting on a roof and is connected to a lower end of an air discharge duct from an air conditioning unit and to the top of an air supply duct in the roof. The roof jack includes an angular-shaped sheet metal lower frame member having a front side, a back side, a first side and second side. A lower portion of the sides of the lower frame member is received around the top of the air supply duct in the roof. Also, the lower portion of the sides of the lower frame member is integrally formed into to an outwardly extending roof flange. The roof flange is adapted for attaching the roof jack to a portion of the roof. The roof jack also includes an angular-shaped sheet metal upper frame member having a front side, a back side, a first side and a second side. A top portion of the front side of the lower frame member is hinged to a bottom portion of the front side of the upper frame member. An angular-shaped flexible boot is attached to an outside of the top portion of the sides of the lower frame member and to an outside of a lower portion of the sides of the upper frame member. The boot is adapted for receipt around a portion of the air discharge duct.

These and other objects of the present invention will become apparent to those familiar with various types of roof jacks used on different pitch roofs when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
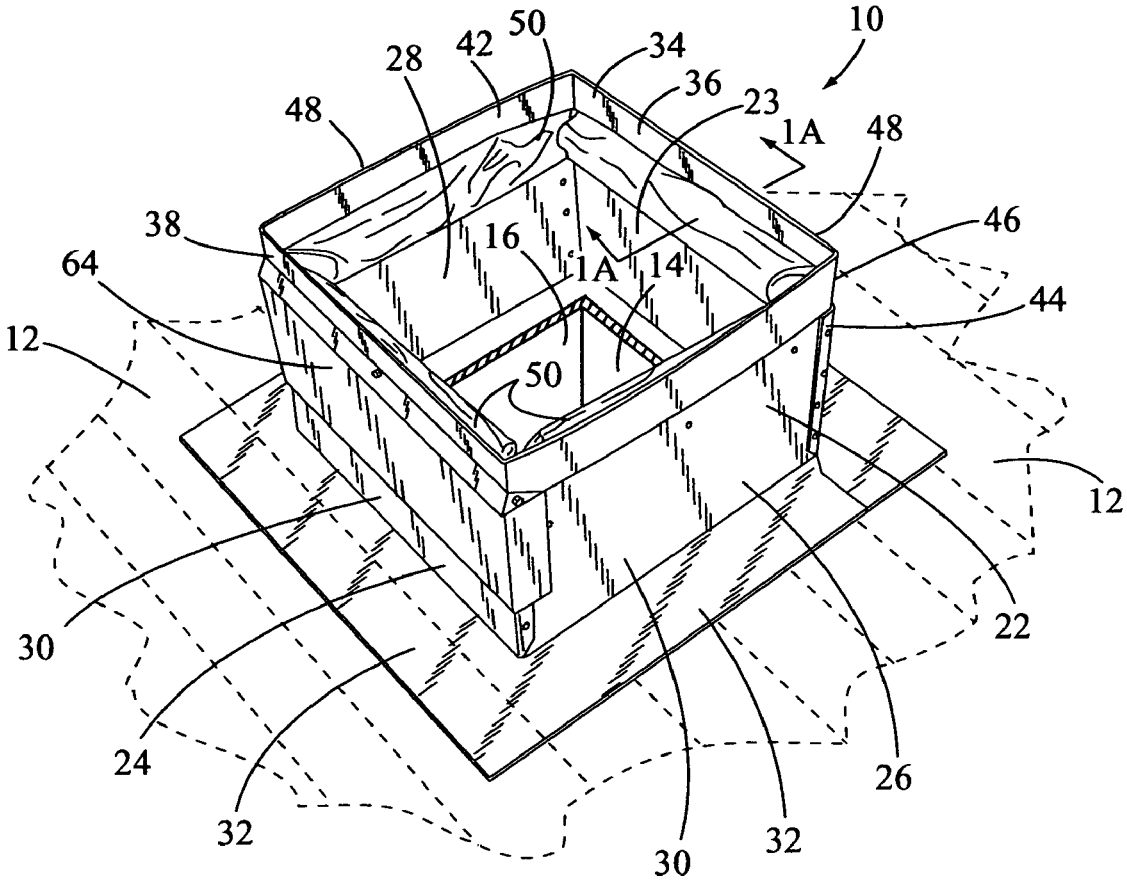
FIG. 1 is a perspective view of the subject adjustable roof jack mounted on a flat roof and received around a top of an air supply duct in the roof.
Figure 2:
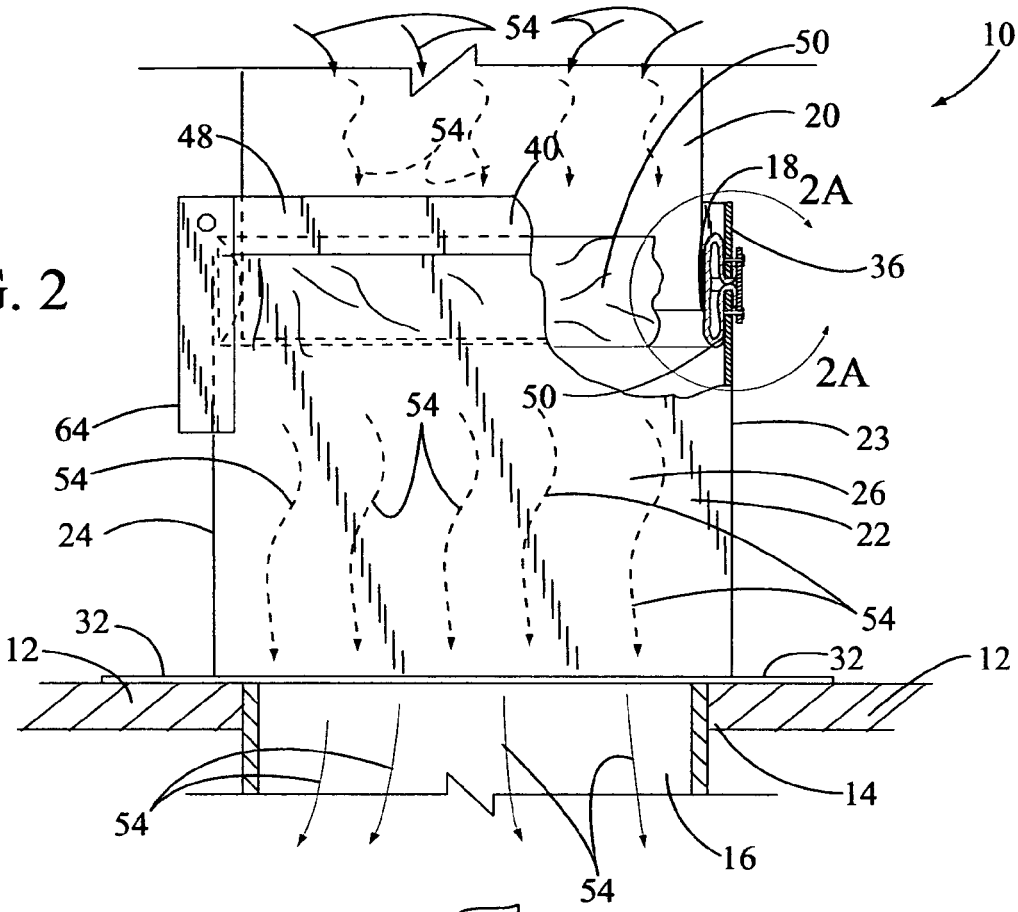
FIG. 2 is a side view of the roof jack shown in FIG. 1. In this view, the top and bottom of the roof jack are shown mounted horizontally and parallel to the flat roof. Also, an air stream is shown circulated from an air discharge duct through the roof jack and into the air supply duct in the roof.
Figure 4:
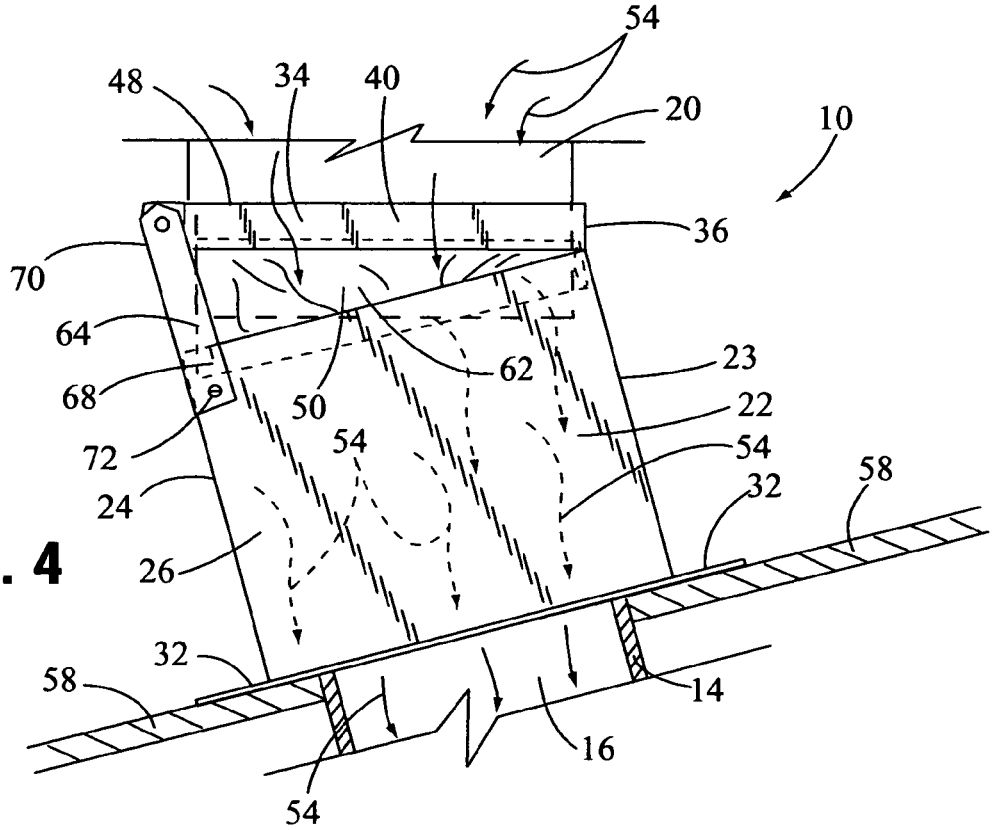
FIG. 4 is a side view of the roof jack shown in FIG. 3. In this view, a top of the roof jack is shown mounted horizontally and the bottom of the roof jack mounted parallel to the pitch of the roof. An air stream is shown circulated from an air discharge duct through the roof jack and into the air supply duct.

In FIG. 1, a perspective view of the subject adjustable roof jack is shown having a general reference numeral 10. In this view, the roof jack 10 is mounted on a flat roof 12 and received around a top 14 of an air supply duct 16 in the roof 12. The adjustable roof jack 10 is adapted for receiving a lower end 18 of an air discharge duct 20 from an air conditioning or heating unit. The air conditioning or heating unit is not shown in the drawings. A portion of the air discharge duct 20 is shown in FIGS. 2 and 4.

The roof jack 10 includes an angular-shaped sheet metal lower frame member 22 having a front side 23, a back side 24, a first side 26 and a second side 28. The front side 23 is typically facing the top of the roof. A lower portion 30 of the sides of the lower frame member 22 is received around the top 14 of the air supply duct 16 in the roof 12. Also, the lower portion 30 of the sides of the lower frame member 22 is integrally formed into an outwardly extending roof flange 32. The roof flange 32 is adapted for attaching the roof jack 10 to a portion of the roof 12 and below the air conditioning or heating unit mounted in the roof.

The roof jack 10 also includes an angular-shaped sheet metal upper frame member 34 having a front side 36, back side 38, a first side 40 and second side 42. The front side 36 faces the top of the roof. A top portion 44 of the front side 23 of the lower frame member 22 is hinged to a bottom portion 46 of the front side 36 of the upper frame member 34. By hinging the upper frame member 34 on top the lower frame member 22, a top 48 of the upper frame 34 can be kept in a horizontal position when the roof jack 10 is used on various pitched roofs. The lower frame member 22 and upper frame member 34 can have a square configuration, a rectangular configuration or any other geometric configuration for adapting to different sizes and shapes of air supply and discharge ducts.

A flexible, tubular boot 50 is attached around the outside of the top portion 44 of the sides of the lower frame member 22 and around the outside of the bottom portion 46 of the sides of the upper frame member 34. The boot 50 is adapted for receipt around a portion of the lower end 18 of the air discharge duct 20 and compressed thereagainst. The boot 50 is made of a heavy duty, waterproof material and is folded lengthwise into it's tubular shape with one edge of the length of the boot attached to the lower edge of the upper frame member 34 and the other edge of the length of the boot attached to the upper edge of the lower frame member 22 as shown in FIGS. 1A, 2A and a cutaway section in FIG. 3.

Figure 1A:
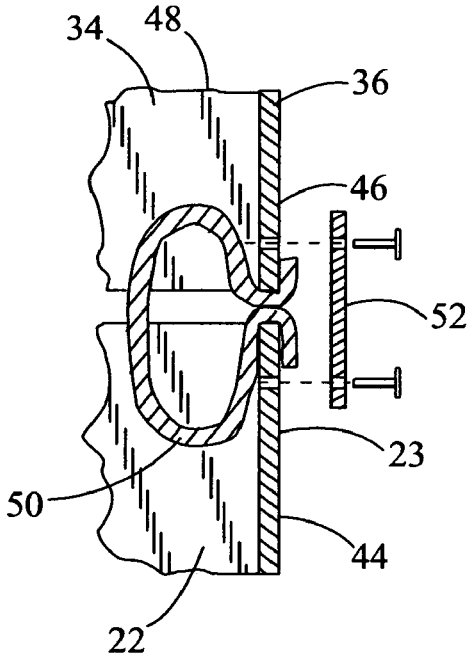
FIG. 1A is an enlarged view of a section of the roof jack's lower frame member, upper frame member and tubular boot.
Figure 3:
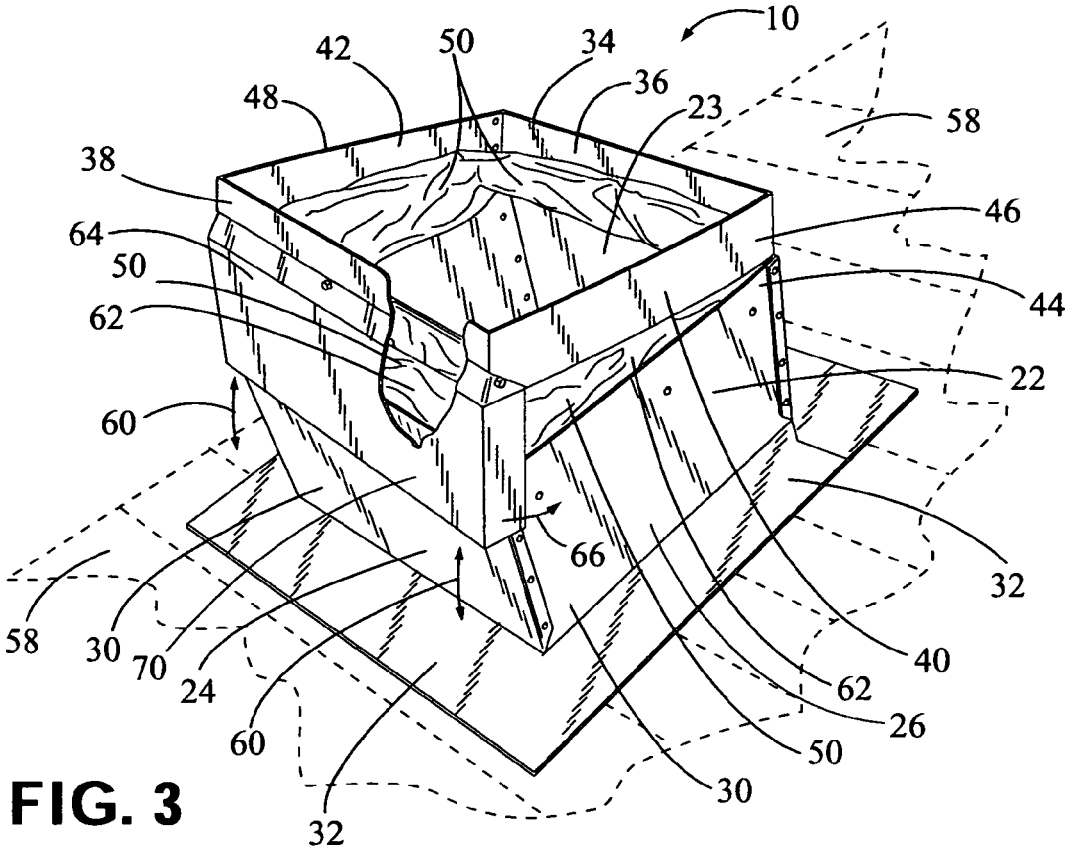
FIG. 3 is a perspective view of the subject adjustable roof jack mounted on a pitched roof and received around a top of an air supply duct in the roof.

In FIG. 1A, an enlarged section of the front side 23 of the lower frame member 22 and an enlarged section of the front side 36 of the upper frame member 34 are shown cutaway to illustrate a cross sectional view of the tubular boot 50 attached thereto. The boot 50 is shown prior to being compressed against a portion of the lower end 18 of the air discharge duct 20. Also, an end of a sheet metal hinge 52 is shown ready for attachment to the upper and lower frame members. The hinge 52 is attached along a length of the front side 23 of the lower frame member 22 and along a length of the front side 36 of the upper frame member 34. The hinge 52 allows the upper frame member 34 to be pivoted on top of the lower frame member 22, as shown in FIGS. 3 and 4. Also, the hinge 52 helps stabilizes and hold the upper frame member 34 in place on top of the lower frame member 22.

In FIG. 2, a side view of the roof jack 10 is shown mounted on the flat roof 12. In this view an air stream, shown as arrows 54, is shown circulated from the air discharge duct 20, through the roof jack 10 and into the air supply duct 16 in the top of the roof 12. In this drawing, a portion of the upper right side of the lower frame member 22 is cutaway to illustrate the lower end 18 of the air discharge duct 16 received inside the top 48 of the roof jack 10.

Figure 2A:
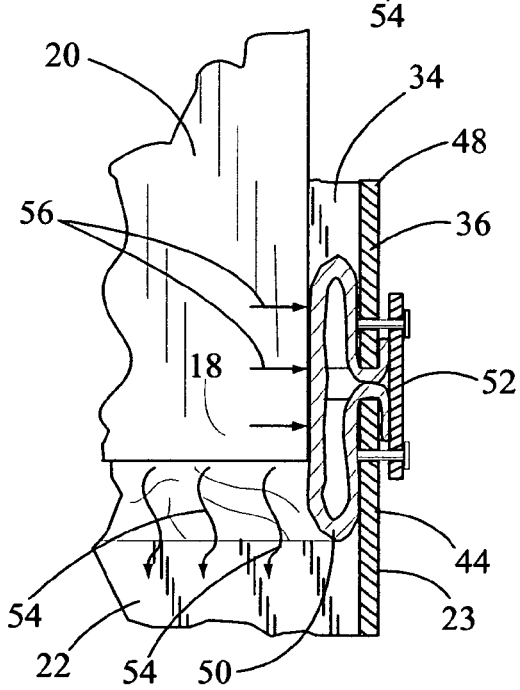
FIG. 2A is an enlarged view of a section of the lower frame member, upper frame member and tubular boot compressed against a lower end of the air discharge duct.

In FIG. 2A, an enlarged sectional view of a portion of the front side 23 of the lower frame member 22 and the front side 36 of the upper frame member 34 is shown. In this view, the lower end 18 of the discharge duct 20 is received in the top 48 of the roof jack 10. The tubular boot 50 is received around the lower end 18 of the duct 20 and compressed against it's sides, as shown by arrows 56.

In FIG. 3, a perspective view of the subject adjustable roof jack 10 is shown mounted on a pitched roof 58 and received around the top 14 of the air supply duct 16 in the roof 58. As mentioned above, the front sides 23 and 36 of the frame members 22 and 34 face toward the top of the roof 58. In this view, the upper frame member 34 is shown pivoted upwardly, as indicated by arrows 60, using the hinge 52. At this time, the tubular boot 50 is extended upwardly covering a space 62 created between the bottom of the upper frame member 34 and the top of the lower frame member 22. Mounted along a length of the back side 38 of the upper frame member 34 and extending downwardly is a boot cap 64. A lower portion of the boot cap 64 is pivoted inwardly, as indicated by arrows 66, toward a top portion of the lower frame member 22 and secured thereto, as shown in FIG. 4.

In this drawing, a portion of the back side 38 of the upper frame member 34 and a portion of the boot cap 64 has been cutaway to illustrate the tubular boot 50 expanded outwardly when the upper frame member 34 is pivoted upwardly to accommodate different pitches of roofs. As mentioned above, the expanded boot 50 covers the space 62 created by the raised upper frame member 34.

In FIG. 4, a side view of the roof jack 10 is illustrated mounted on top of the roof 58. In this view, the top 48 of the roof jack 10 is shown horizontal to the pitch of the roof 58. The air stream 54 is shown circulated from the air discharge duct 20, through the roof jack 10 and into the air supply duct 16. In this view, the boot cap 64 has been pivoted toward and against the top portion of the back side 24 of the lower frame member 22. Opposite sides 68 bent at right angles to a front 70 of the boot cap 64 are attached to a portion of the first and second sides 26 and 28 of the lower frame member 22 using sheet metal screws 72. The securing of the boot cap 64 to the lower frame member 22 provides stability and rigidity to the upper frame member 34 on the lower frame member 22.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. An adjustable roof jack adapted for mounting on a flat or pitched roof, the roof jack is designed to engage a lower end of an air discharge duct from an air conditioning unit and received around a top of an air supply duct in the roof, the roof jack comprising:

a lower frame member having a front side, a back side, a first side and second side, a lower portion of the sides of said lower frame member adapted for receipt around the top of the air supply duct;

an upper frame member having a front side, a back side, a first side and second side, a top portion of the front side of said lower frame member hinged to a bottom portion of the front side of the upper frame member; and a flexible, expandable boot attached to a top portion of the sides of said lower frame member and attached to a lower portion of the sides of said upper frame member, said flexible boot adapted for receipt around a portion of the lower end of the air discharge duct, said boot expanding upwardly for covering a space created between a bottom of said upper frame member and a top of said lower frame member when the adjustable roof jack is mounted on a pitched roof.

2. The roof jack as described in claim 1 wherein a lower portion of the sides of said lower frame member is attached to an outwardly extending roof flange, said roof flange adapted for securing the roof jack on the roof.

3. The roof jack as described in claim 1 further including a boot cap, a top portion of said boot cap attached to the first and second sides of said upper frame member and extending downwardly therefrom, a bottom portion of said boot cap attached to the first and second sides of said lower frame member, said boot cap providing stability and rigidity of said upper frame member on said lower frame member.

4. The roof jack as described in claim 1 further including a metal hinge, said hinge attached along a length of the front sides of said upper frame member and said lower frame member, said metal hinge allowing said upper frame member to pivot on top of said lower frame member.

5. An adjustable roof jack adapted for mounting on a flat or pitched roof, the roof jack is designed to engage a lower end of an air discharge duct from an air conditioning unit and received around a top of an air supply duct in the roof, the roof jack comprising:

an angular-shaped sheet metal lower frame member having a front side, a back side, a first side and second side, a lower portion of the sides of said lower frame member adapted for receipt around the top of the air supply duct;

an angular-shaped sheet metal upper frame member having a front side, a back side, a first side and second side, a top portion of the front side of said lower frame member hinged to a bottom portion of the front side of said upper frame member; and a tubular-shaped, expandable flexible boot attached to an inside of the top portion of the sides of said lower frame member and attached to an inside of a lower portion of the sides of said upper frame member, said flexible boot adapted for receipt around a portion of the air discharge duct discharge duct, said boot expanding upwardly for covering a space created between a bottom of said upper frame member and a top of said lower frame member when the adjustable roof jack is mounted on a pitched roof.

6. The roof jack as described in claim 5 wherein a lower portion of the sides of said lower frame member is integrally formed into an outwardly extending roof flange, said roof flange adapted for securing the roof jack on the roof.

7. The roof jack as described in claim 5 further including a boot cap, a front of said boot cap disposed in front of a portion of the back sides of said upper frame member and said lower frame member, a top portion of said boot cap pivotally attached to the first and second sides of said upper frame member and extending downwardly therefrom, sides of a bottom portion of said boot cap attached to the first and second sides of said lower frame member using metal screws, said boot cap providing stability and rigidity of said upper frame member on said lower frame member.

8. The roof jack as described in claim 5 further including a sheet metal hinge, said hinge attached along a length of the bottom portion of the front side of said upper frame member and along a length of the top portion of the front side of said lower frame member, said metal hinge allowing said upper frame member to pivot on top of said lower frame member.

9. An adjustable roof jack adapted for mounting on a flat or pitched roof, the roof jack is designed to engage a lower end of an air discharge duct from an air conditioning unit and received around a top of an air supply duct in the roof, the roof jack comprising:

an angular-shaped sheet metal lower frame member having a front side, a back side, a first side and second side, a lower portion of the sides of said lower frame member adapted for receipt around the top of the air supply duct;

an angular-shaped, outwardly extending roof flange, said flange integrally attached to the lower portion of the sides of said lower frame member, said flange adapted for securing the roof jack to the top of the roof;

an angular-shaped sheet metal upper frame member having a front side, a back side, a first side and second side, a top portion of the front side of said lower frame member hinged to a bottom portion of the front side of said upper frame member;

a flexible, expandable boot attached to the top portion of the sides of said lower frame member and to a bottom portion of the sides of said upper frame member, said flexible boot adapted for receipt around a portion of the air discharge duct air discharge duct discharge duct, said boot expanding upwardly for covering a space created between a bottom of said upper frame member and a top of said lower frame member when the adjustable roof jack is mounted on a pitched roof; and a boot cap pivotally attached to the back side of said upper frame member and extending downwardly therefrom, a bottom portion of said boot cap attached to said lower frame member, said boot cap covering a portion of said expandable boot when the adjustable roof jack is mounted on a pitched roof.

10. The roof jack as described in claim 9 further including a metal hinge, said hinge attached along a length of the front sides of said upper frame member and said lower frame member, said metal hinge allowing said upper frame member to pivot on top of said lower frame member, said metal hinge providing stability of said upper frame member on top of said lower frame member.

11. The roof jack as described in claim 9 wherein a front of said boot cap disposed in front of a portion of the back sides of said upper frame member and said lower frame member, a top portion of said boot cap pivotally attached to the first and second sides of said upper frame member and extending downwardly therefrom, sides of a bottom portion of said boot cap attached to the first and second sides of said lower frame member using metal screws, said boot cap providing stability and rigidity of said upper frame member on said lower frame member.

12. The roof jack as described in claim 9 wherein said flexible boot is a flexible tubular shaped boot attached to an inside of the top portion of the sides of said lower frame member and attached to an inside of a lower portion of the sides of said upper frame member, said flexible boot adapted for receipt around a portion of the air discharge duct.

* * * * *